US010765204B2

(12) United States Patent
Guizzardi et al.

(10) Patent No.: US 10,765,204 B2
(45) Date of Patent: Sep. 8, 2020

(54) ASSEMBLABLE MODULAR WARDROBE MADE OF PLASTIC MATERIAL

(71) Applicant: TERRY STORE-AGE S.P.A., Milan (IT)

(72) Inventors: Massimo Guizzardi, Milan (IT); Ottavio Di Blasi, Milan (IT)

(73) Assignee: TERRY STORE-AGE S.P.A., Milan (IT)

( * ) Notice: Subject to any disclaimer, the term of this patent is extended or adjusted under 35 U.S.C. 154(b) by 0 days.

(21) Appl. No.: 16/471,098

(22) PCT Filed: Dec. 11, 2017

(86) PCT No.: PCT/EP2017/082243
§ 371 (c)(1),
(2) Date: Jun. 19, 2019

(87) PCT Pub. No.: WO2018/114438
PCT Pub. Date: Jun. 28, 2018

(65) Prior Publication Data

US 2019/0313790 A1 Oct. 17, 2019

(30) Foreign Application Priority Data

Dec. 20, 2016 (IT) ..... 202016000128813

(51) Int. Cl.
*A47B 47/04* (2006.01)
*A47B 61/00* (2006.01)
*A47B 47/05* (2006.01)

(52) U.S. Cl.
CPC ..... *A47B 47/047* (2013.01); *A47B 47/042* (2013.01); *A47B 47/05* (2013.01); *A47B 61/00* (2013.01)

(58) Field of Classification Search
CPC ..... A47B 47/047; A47B 61/00; A47B 47/042; A47B 47/05
See application file for complete search history.

(56) References Cited

U.S. PATENT DOCUMENTS 4,083,458 A * 4/1978 Young, Jr. ..... A47B 47/05 108/180
5,372,415 A * 12/1994 Tisbo ..... A47B 47/042 312/108

(Continued)

FOREIGN PATENT DOCUMENTS

| | | |
|---|---|---|
| ES | 2 318 938 | 5/2009 |
| FR | 1.427.967 | 12/1964 |

OTHER PUBLICATIONS

International Search Report and Written Opinion issued in corresponding International Patent Application No. PCT/EP2017/082243 dated Apr. 13, 2018.

*Primary Examiner* — Hanh V Tran
(74) *Attorney, Agent, or Firm* — Troutman Pepper Hamilton Sanders LLP

(57) ABSTRACT

An Assemblable wardrobe made of a plastic material, comprising a first and at least a second module positioned one above the other, where each module comprises two side panels, a rear panel, at least a shelf and a reinforcing structure, the reinforcing structure comprising an upper cross-member and respectively a lower cross-member arranged along upper and respectively lower sides of the rear panel and a connecting upright joining said cross-members, each module further comprising an L-shaped support having a vertical wing connected along the connecting upright and a horizontal wing for supporting the shelf, the L-shaped support has clamping means of the upper cross-member to the lower cross-member of the overlying module.

12 Claims, 11 Drawing Sheets

(56) References Cited

U.S. PATENT DOCUMENTS 5,931,553 A * 8/1999 Cohen ..... A47B 91/024 312/108
5,975,660 A * 11/1999 Tisbo ..... A47B 47/045 312/108
6,202,867 B1 * 3/2001 Di Blasi ..... A47B 47/0075 108/138
6,820,950 B1 * 11/2004 Sun ..... A47B 47/042 312/108
D591,076 S * 4/2009 Guizzardi ..... D6/671.1
2002/0043905 A1 * 4/2002 Insalaco ..... A47B 47/00 312/108
2002/0109442 A1 * 8/2002 Hsu ..... A47B 47/042 312/263
2002/0171332 A1 * 11/2002 Skov ..... A47B 87/0276 312/107
2005/0162051 A1 * 7/2005 Madsen ..... A47B 47/047 312/287
2006/0108899 A1 * 5/2006 Jin ..... A47B 43/00 312/257.1
2008/0084149 A1 * 4/2008 Ho ..... A47B 43/00 312/258
2010/0237031 A1 * 9/2010 Kunis ..... A47B 61/00 211/86.01
2010/0253196 A1 * 10/2010 Nye ..... A47B 47/042 312/352
2011/0280655 A1 * 11/2011 Maertens ..... E04F 15/02 403/375
2014/0152160 A1 * 6/2014 Tontarelli ..... A47B 47/04 312/265.5
2014/0169869 A1 * 6/2014 Brumfield ..... A47B 47/042 403/373
2016/0088936 A1 * 3/2016 Mitchell ..... A47B 47/042 312/108
2016/0166059 A1 * 6/2016 Zohar ..... A47B 81/02 312/257.1
2017/0035197 A1 * 2/2017 Franco ..... A47B 47/0091
2017/0188703 A1 * 7/2017 Wobser ..... A47B 47/042
2017/0311716 A1 * 11/2017 Vandenham ..... A47B 47/0041
2018/0092460 A1 * 4/2018 Stack ..... A47B 47/042

* cited by examiner

ASSEMBLABLE MODULAR WARDROBE MADE OF PLASTIC MATERIAL

CROSS REFERENCE TO RELATED APPLICATIONS

This is a U.S. National Phase Application under 35 U.S.C. § 371 of International Patent Application No. PCT/EP2017/082243, filed Dec. 11, 2017, which claims priority of Italian Patent Application No. 202016000128813, filed Dec. 20, 2016. The entire contents of which are hereby incorporated by reference.

BACKGROUND

The present invention relates to an assemblable modular wardrobe made of plastic material. Assemblable wardrobes are known to be formed by a body formed by an upper panel, a lower panel, side panels and a rear panel which are closable by means of front doors.

The wardrobes internally include one or more horizontal shelves, where said shelves are supported by fixed or removable supports positioned on the internal surface of the rear panel and/or the side panels.

A problem of such embodiments comes from the fact that the weight of the items placed on the shelves tends to be discharged onto the supports of the shelf itself and therefore on the wardrobe panels which, in some cases, can be deformed or bent under this effect.

An object of the invention is to provide an assemblable modular wardrobe structured in such a way as to prevent the deformation of the panel due to the forces acting on the internal shelves of the wardrobe itself.

Another object of the invention is to obtain the aforementioned results in a practical and cost-effective way.

These aims are attained by an assemblable wardrobe made of a plastic material, comprising a first and at least a second module positioned one above the other, where each module comprises two side panels, a rear panel, at least a shelf and a reinforcing structure, characterized in that said reinforcing structure comprises an upper cross-member and respectively a lower cross-member arranged along upper and respectively lower sides of the rear panel and a connecting upright joining said cross-members, each module further comprising an L-shaped support having a vertical wing connected along said upright and a horizontal wing supporting the shelf, the L-shaped support having clamping means of the upper cross-member for clamping the lower cross-member of the overlying module.

The present invention also describes a kit for realising an assemblable wardrobe made of a plastic material, comprising a first and at least a second module superposable, where for the construction of each module a separate and independent plurality of components is included, comprising a rear panel, two side panels couplable to the rear panel at least a shelf, and an L-shaped support for the shelf, characterized in that a reinforcing structure is integrated in said panel comprising an upper cross-member and respectively a lower cross-member arranged along upper and respectively lower sides of the rear panel, and a connecting upright joining said cross-members, said L-shaped support having a vertical wing of the shelf that is connectable along said upright and a horizontal wing having clamping means of the upper cross-member to the lower cross-member of the overlying module.

An advantage of this embodiment comes from the fact that the weight supported by the shelves sustained by the L-shaped support is discharged on the reinforcing structure so as to prevent the deformation of the rear panels of the wardrobe.

Further characteristics of the invention can be inferred from the dependent claims.

BRIEF DESCRIPTION OF THE DRAWINGS

Further characteristics and advantages will be evident from reading the following description by way of non-limiting example with the aid of the figures illustrated in the appended drawings, where.

DETAILED DESCRIPTION

Figure 1:
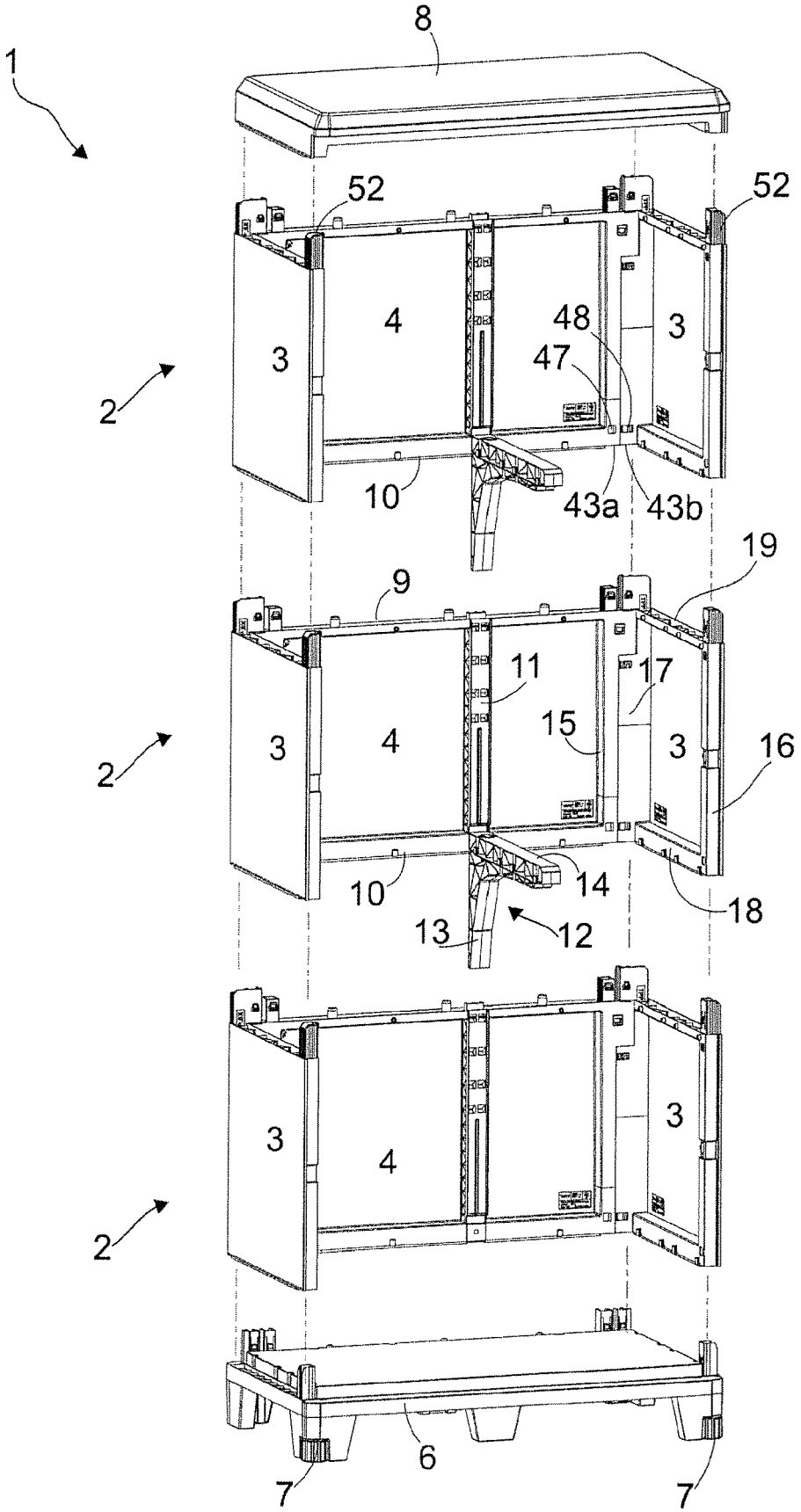
FIG. 1 is a partly-exploded view of an embodiment of the assemblable wardrobe with a reinforced structure according to the invention, in which the shelves are not illustrated.
Figure 2:
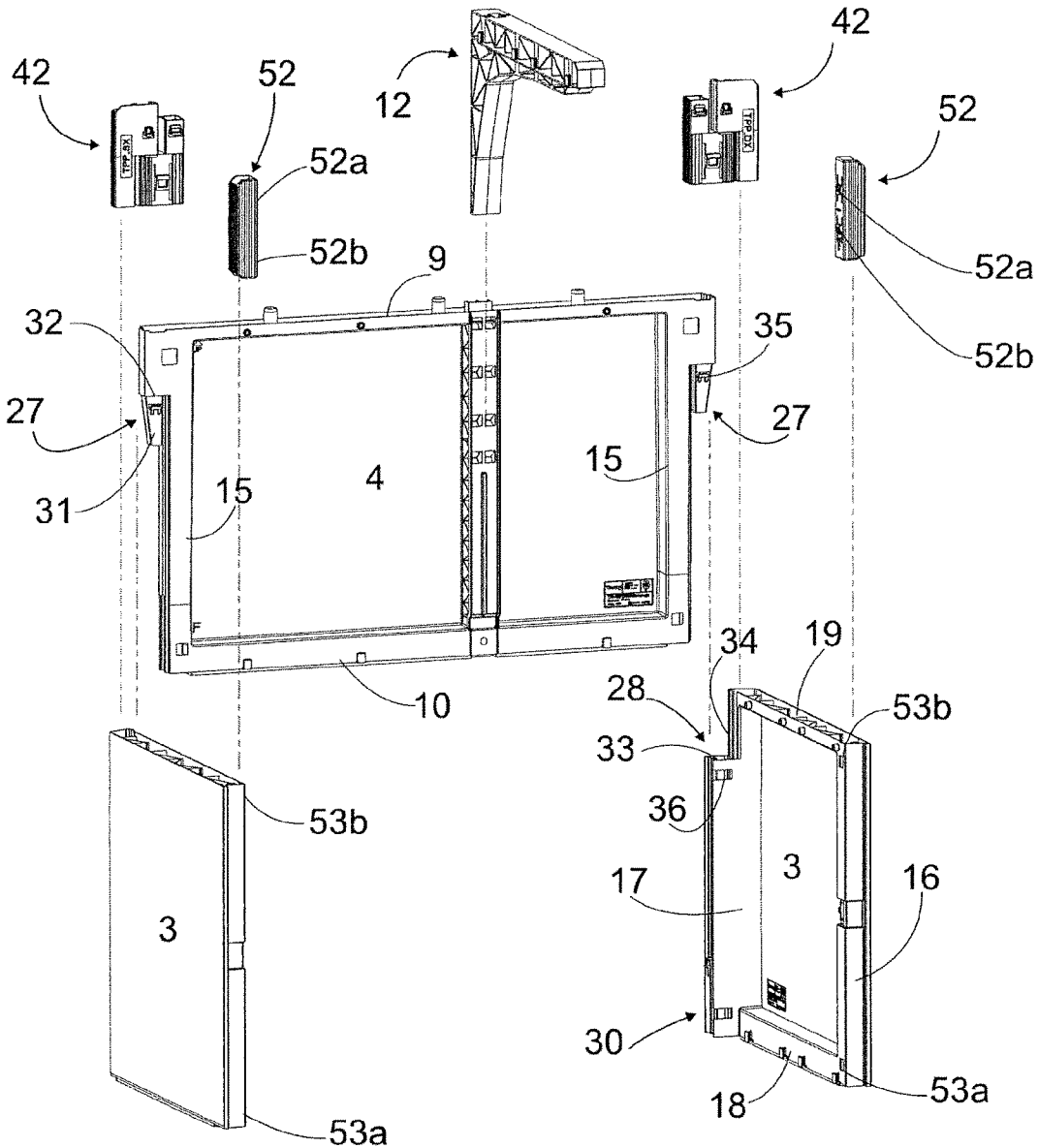
FIG. 2 is an exploded view of a module of the assemblable wardrobe of FIG. 1 in which the shelves are not illustrated.
Figure 3:
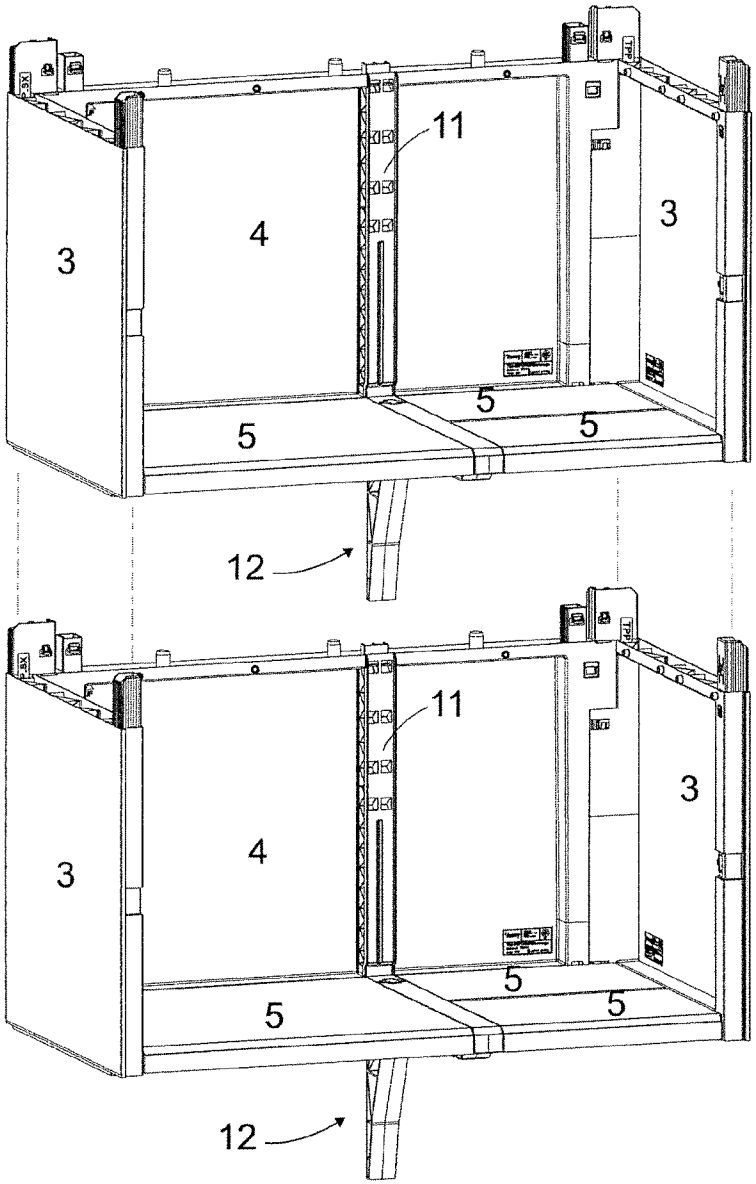
FIG. 3 illustrates two assembled modules of the assemblable wardrobe of FIG. 1 before reciprocal connection.
Figure 4:
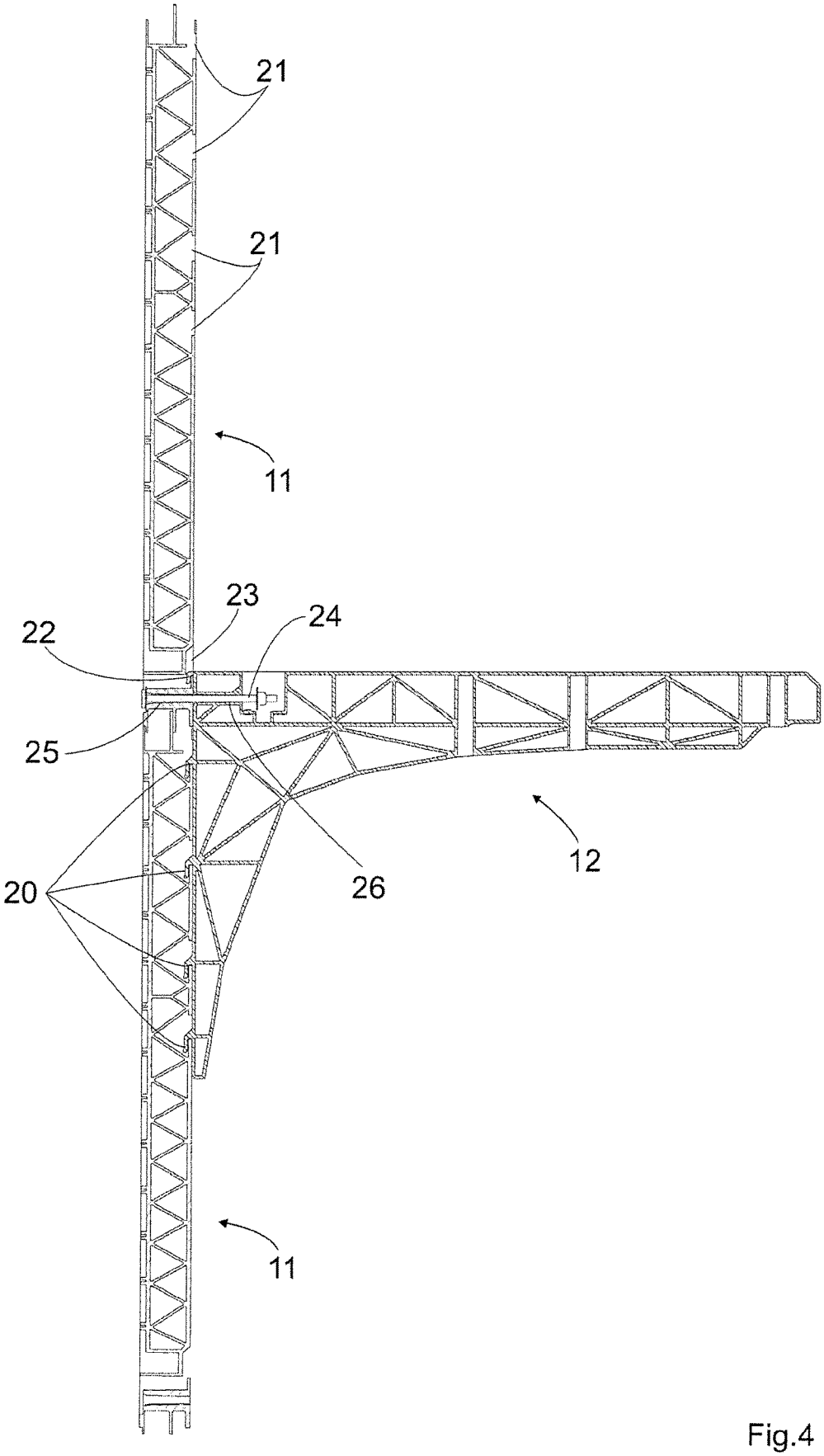
FIG. 4 is a lateral elevation view of the connection node between the L-shaped support and the adjacent cross-members of the superposed rear panels of the assemblable wardrobe of FIG. 1.
Figure 5:
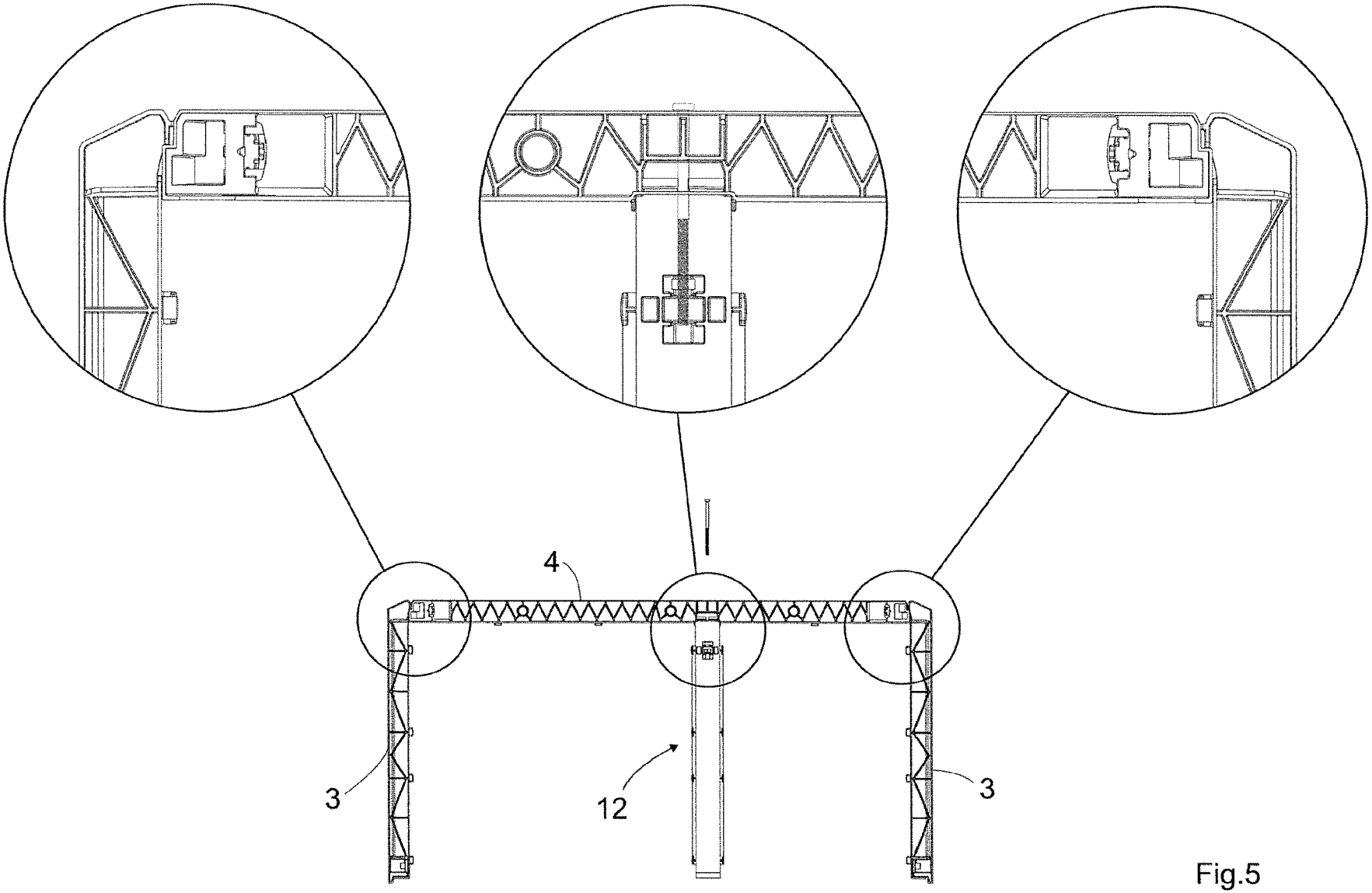
FIG. 5 illustrates, in plan view, the module and some details in large scale of the assemblable wardrobe of FIG. 1 in larger scale.
Figure 6:
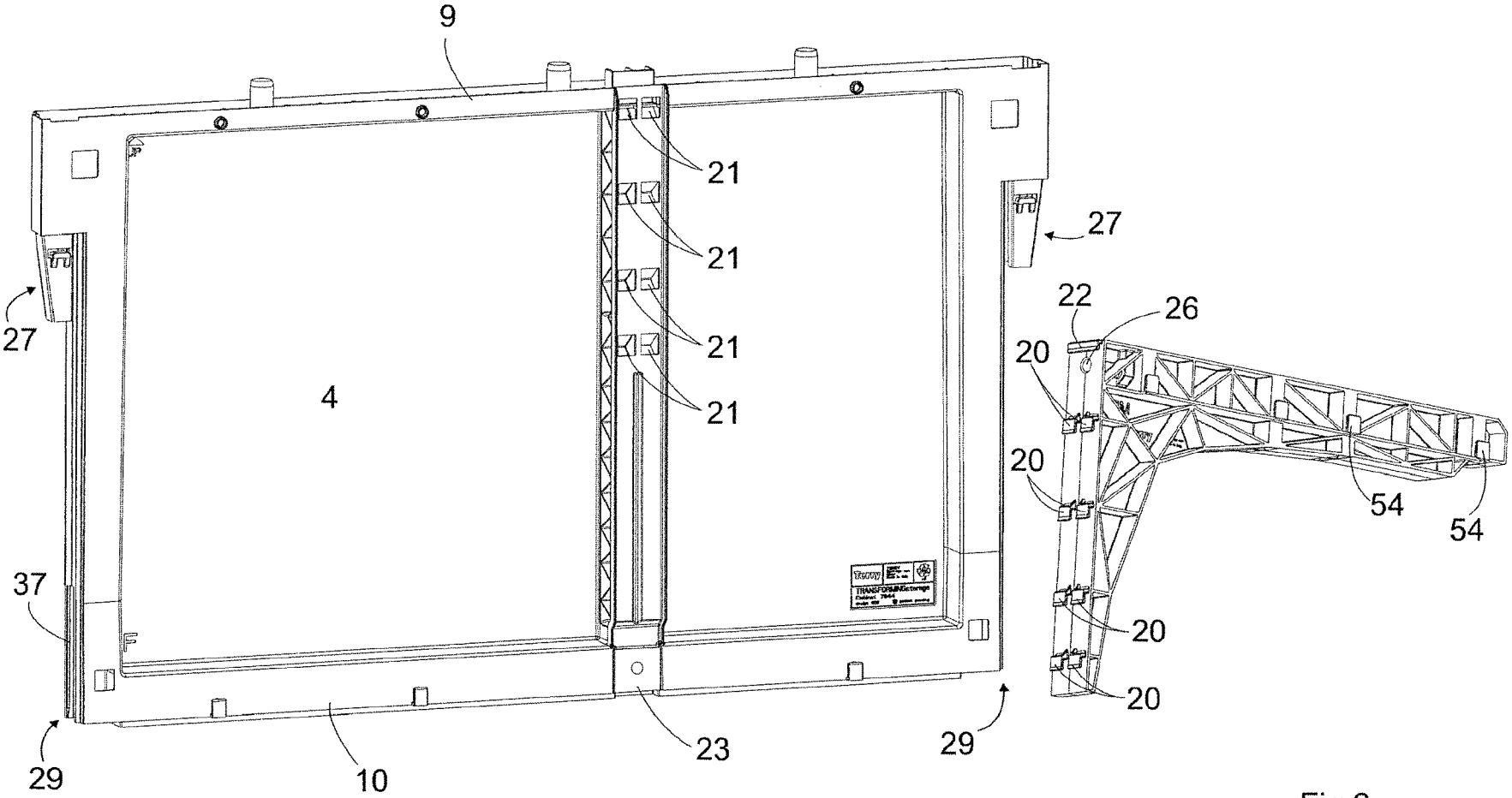
FIG. 6 illustrates the rear panel and the L-shaped support of a module of the assemblable wardrobe of FIG. 1.
Figure 7:
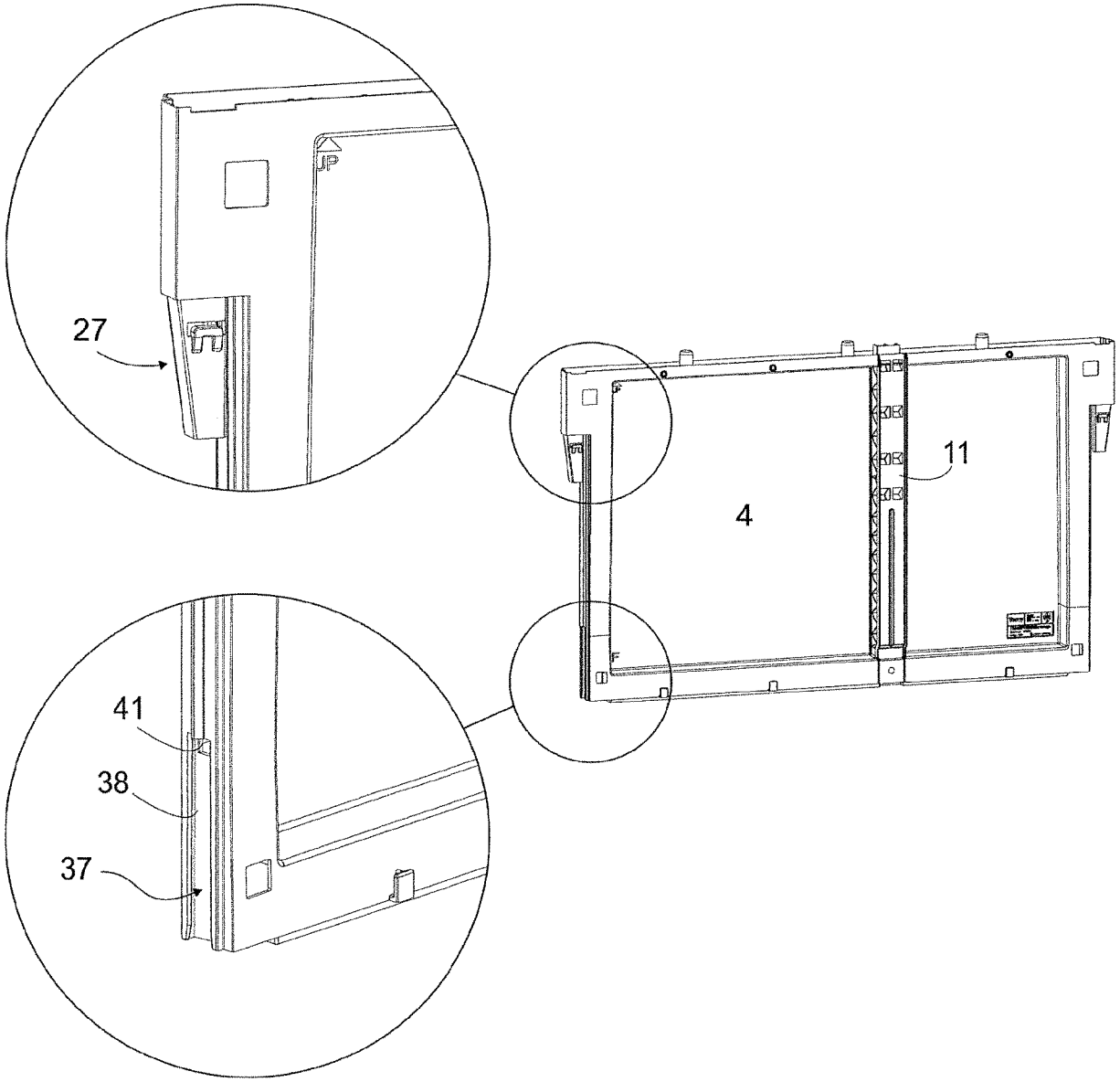
FIG. 7 illustrates the rear panel and some parts in larger scale of a module of the assemblable wardrobe of FIG. 1.
Figure 8:
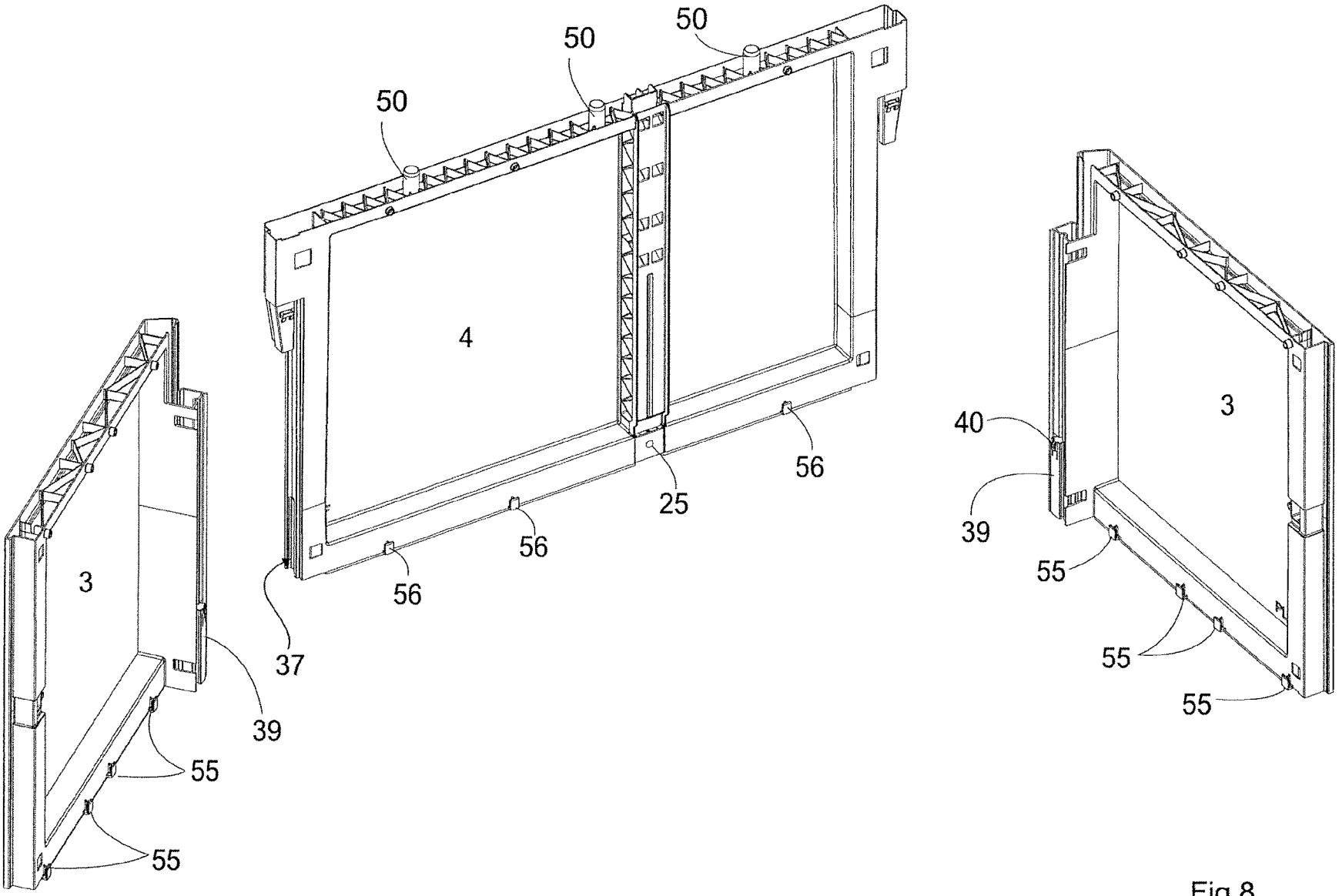
FIG. 8 illustrates the rear panel and the side panels of a module of the assemblable wardrobe of FIG. 1.
Figure 9:
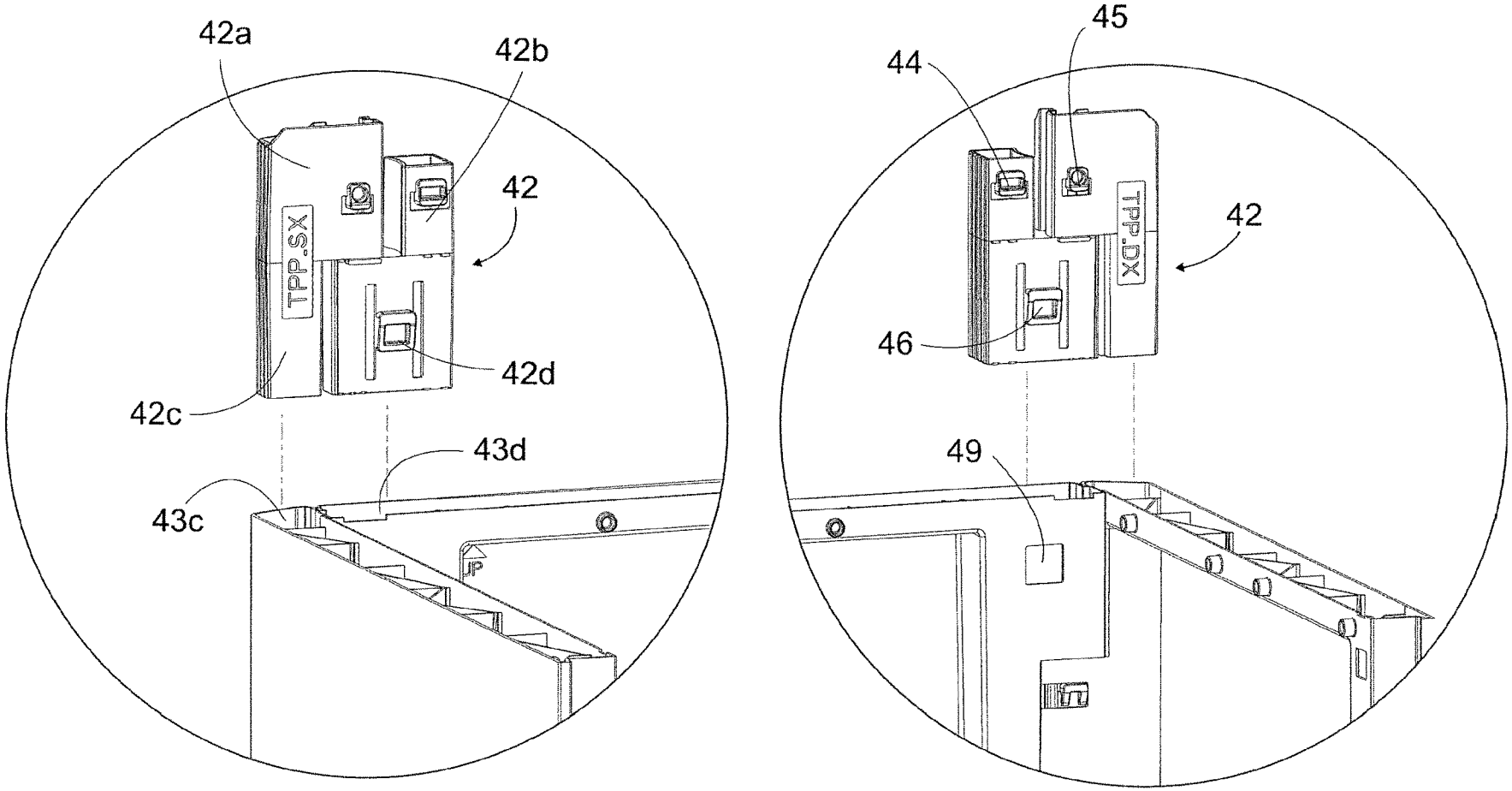
FIG. 9 illustrates the join zone of the right and left corner between the rear panel and the side panels of a module of the assemblable wardrobe of FIG. 1.
Figure 10:
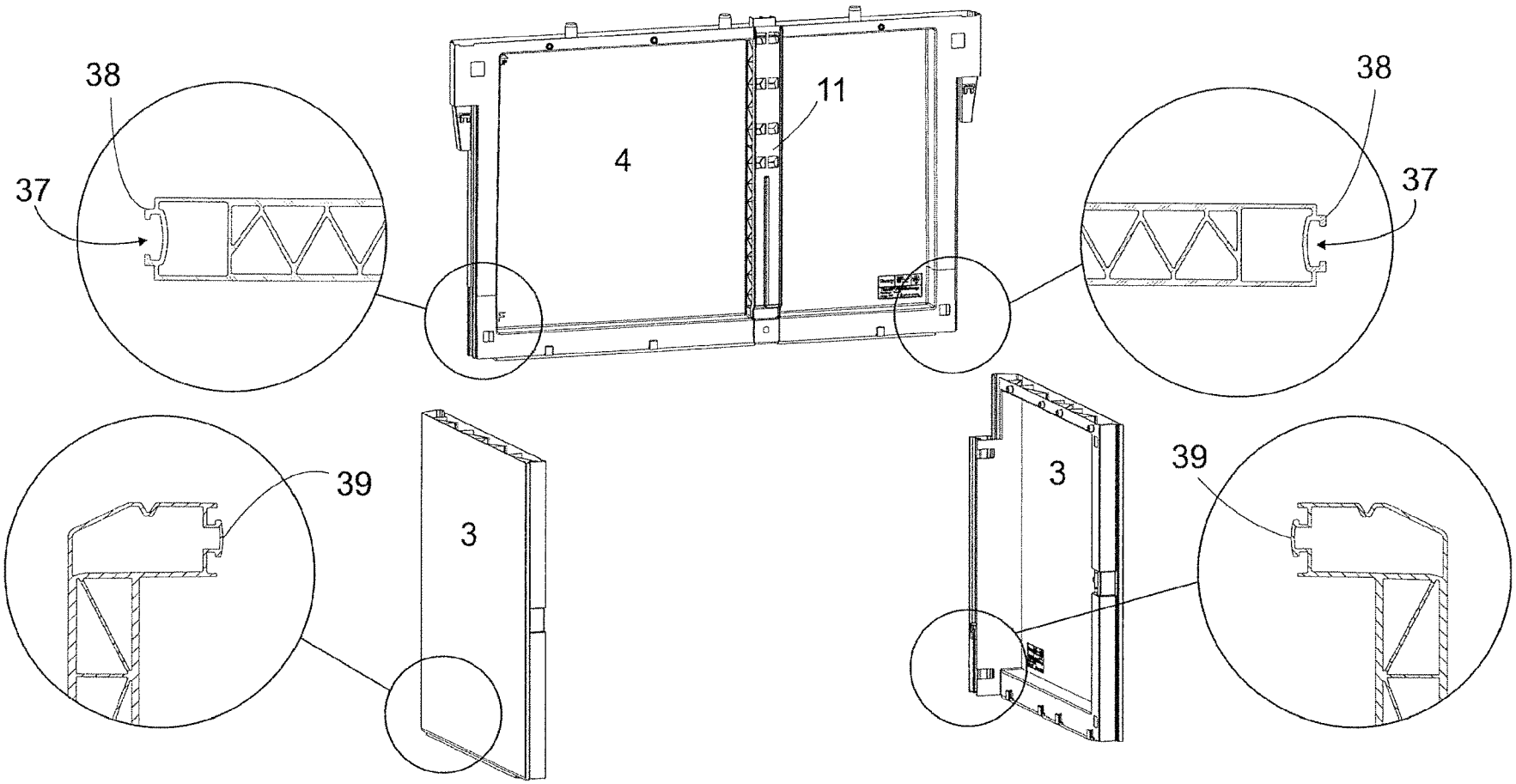
FIG. 10 illustrates the rear panel and the side panels and some parts in larger scale in a different perspective of a module of the assemblable wardrobe of FIG. 1.
Figure 11:
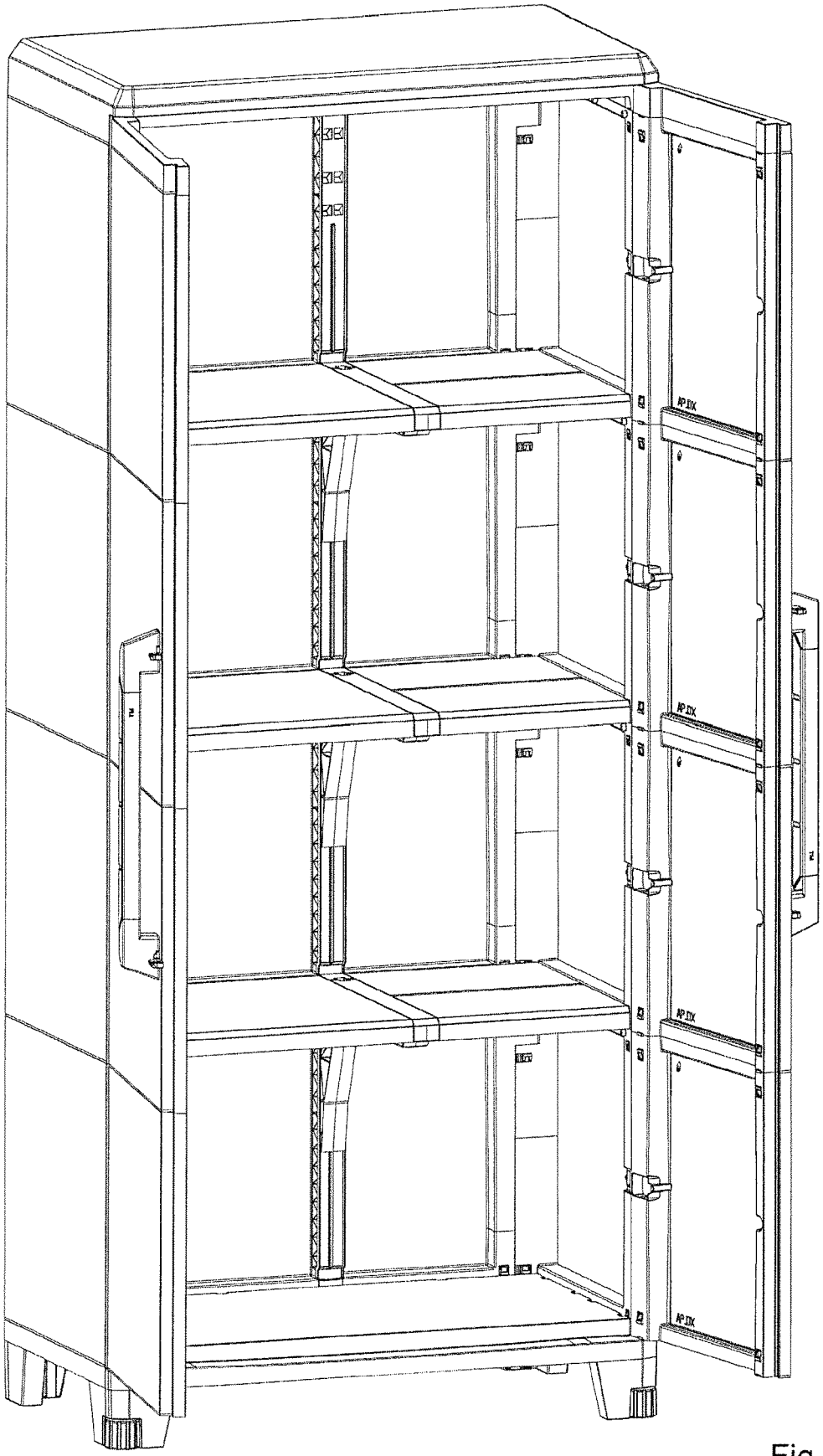
FIG. 11 shows the wardrobe of FIG. 1 completely assembled.

In the description that follows the term vertical is taken to mean a perpendicular direction to the support plane of the wardrobe, and the term horizontal is taken to mean a parallel direction to the support plane of the wardrobe.

With particular reference to the appended figures, an assemblable wardrobe is highlighted, indicated overall with reference number 1, and made of plastic material.

The wardrobe 1 is formed by a plurality of two or more modules 2 stacked one above the other, where each module 2 comprises two side panels 3, a rear panel 4, one or more shelves 5 and a reinforcing structure.

The number of the modules 2 that can stack one above the other so as to determine the height of the wardrobe 1 can be chosen as desired according to needs and space available.

A base 6 is applied to the lower module 2, which base 6 is provided with feet 7, preferably adjustable, while a top 8 is applied to the upper module.

The modules 2 may or may not include closing doors of the compartment delimited by the rear panels 4, the side panels 3, the top 8 and the base 6.

The reinforcing structure comprises an upper cross-member 9 and respectively a lower cross-member 10 arranged along the upper and respectively lower side of the rear panel 4 and a connecting upright 11 joining said cross-members 9, 10.

Each module 2 further comprises an L-shaped support 12 having a vertical wing 13 connected along the connecting upright 11 and a horizontal wing 14 for supporting each shelf 5 associated to the module 2.

The L-shaped support 12 advantageously has clamping means of the upper cross-member 9 to the lower cross-member 10 of the overlying module 2.

The upper and lower cross-members 9, 10 of each module 2 are formed in a single piece with the rear panel 4, and in particular project from the internal side of the rear panel 4.

In the same way the connecting upright 11 is also formed in a single piece with the rear panel 4, and in particular is formed in an intermediate position in the rear panel 4 and projects from the internal side thereof.

Side uprights 15 are provided along the lateral sides of the rear panel 4.

The side uprights 15 are also formed in a single piece with the rear panel 4, and in particular project from the internal side of the rear panel 4.

The upper and lower cross-members 9, 10 and the side uprights 15 form a frame of the rear panel 4.

The side panel 3 also has a frame comprising a front upright 16, a rear upright 17, a lower cross-member 18 and an upper cross-member 19 formed in a single piece with the side panel 3 and projecting from the internal side thereof.

The rear upright 17 of the side panel 3 has a transversal section that is elongate in a perpendicular direction to the side panel 3 and is juxtaposed at the side upright 15 of the rear panel 4.

The vertical wing 13 of the L-shaped support 12 is connected along the connecting upright 11 by means of engagement of grooved couplings 20 with corresponding grooved couplings 21 of the connecting upright 11.

The grooved couplings 20 are fashioned on a flat rear side of the vertical wing 13 of the L-shaped support 12 and are vertically spaced at regular pitches while the corresponding grooved couplings 21 are fashioned on a flat front side of the connecting upright 11.

The clamping means comprises at least a grooved coupling 22 engaged with a corresponding grooved coupling 23 of the lower cross-member 10 of the rear panel 4 of the overlying module 2.

In particular a single grooved coupling 22 positioned at the upper end of the flat rear side of the vertical wing 13 of the L-shaped support 12.

Such grooved coupling 22 extends over the whole width of the L-shaped support 12.

The clamping means advantageously also comprises at least a locking bolt 24 of the L-shaped support 12 for locking the lower cross-member 10 of the rear panel 4 of the overlying module 2.

The locking bolt 24 is in particular inserted to pass through the aligned horizontal holes 26, 25 of the L-shaped support 12 and the lower cross-member 10 of the rear panel 4 of the overlying module 2.

The side upright 15 of the rear panel 4 and the rear upright 17 of the side panel 3 advantageously have upper couplings 27, 28 and lower couplings 29, 30 for reciprocal connection.

The upper coupling 27 of the side upright 15 of the rear panel 4 is formed by a tapered engaging tooth 31 which vertically extends below a shoulder 32 of the side upright 15 of the rear panel 4, while the corresponding upper coupling 28 of the rear upright 17 of the side panel 3 is formed by a cavity 33 which vertically extends inside a shoulder 34 of the rear upright 17 of the side panel 3.

The upper block between the side upright 15 of the rear panel 4 and the rear upright 17 of the side panel 3 is consolidated by a snap-fitting organ 35 provided projectingly on the tooth 31 and engaged in a snap-fitting seating 36 included along the rear upright 17 of the side panel 3 which delimits the cavity 33.

The lower coupling 29 of the side upright 15 of the rear panel 4 is formed by a groove 37 which faces a window 38 which, starting from the lower end of the lateral side of the side upright 15 of the rear panel 4 extends vertically along the lateral side of the side upright 15 of the rear panel 4.

The lower coupling 30 of the rear upright 17 of the side panel 3 is in the form of a vertical protrusion 39 which extends outside the lateral side of the rear upright 17 of the side panel 3.

The vertical protrusion 39 is connected only at the lower end thereof to the lateral side of the rear upright 17 of the side panel 3 in order to be able to slide in the groove 37.

The lower block between the side upright 15 of the rear panel 4 and the rear upright 17 of the side panel 3 is consolidated by a snap-fitting organ 40 provided projectingly on the vertical protrusion 39 and engaged in a snap-fitting seating 41 included along the part of the rear upright 17 of the side panel 3 which delimits the groove 37.

For the interconnection at corners between adjacent modules 2 special dowels 42, 52 are provided.

Each interconnecting dowel 42 connects the side upright 15 of the rear panel 4 and the rear upright 17 of the side panel 3 of a module 2 to the homologous members of the overlying module 2.

Each interconnecting dowel 52, on the other hand, connects the front uprights 16 of the side panels 3.

The interconnecting dowel 42 in particular has two upper vertical sections 42*a*, 42*b* each engaged in a corresponding housing 43*a*, 43*b* and two lower vertical sections 42*c*, 42*d* each engaged in a corresponding housing 43*c*, 43*d*.

The interconnecting dowel 42 has in turn teeth 44, 45, 46 inserted in snap-fitting blocking seatings 47, 48, 49 of the connection.

The interconnecting dowel 52 in particular has an upper vertical section 52*a*, and a lower vertical section 52*b* each engaged in a corresponding housing 53*a*, 53*b*.

Connecting plugs 50 are formed in a single piece with the upper rear cross-member 9 of the rear panel 4, for connection to the lower cross-member 10 of the rear panel 4 of the overlying module 2.

The plugs 50 are distributed in a regular pitch along the upper rear cross-member 9 of the rear panel 4 and are engaged in corresponding seatings (not illustrated) so as to create, between the modules 2, a series of anchoring points uniformly distributed along the direction of the width of the wardrobe 1.

In order to increase the mechanical resistance of the wardrobe 1 preferably at least the L-shaped support 12, the connecting upright 11, the cross-members 9, 10 and the cross-members 18, 19 of the side panels 3 are formed by reticular structures.

For the assembly of each module 2 the side panels 3 are connected to the rear panel 4 by means of the joint between the couplings 27, 29 of the rear wall 4 and the corresponding couplings 28, 30 of each lateral wall 3.

At this point, for each module 2 with the exception of the lower module, the L-shaped support 12 is connected to the lower cross-member 10 of the rear panel 4 by means of the joint between the coupling 22 included on the L-shaped support 12 and the coupling 23 included on the lower cross-member of the module 2.

Then the interconnecting dowels 42, 52 are applied at the upper corners of each module 1 by means of engagement of the lower sections 42*c*, 42*d* of the interconnecting dowels 42 in the corresponding housings 43*b*, 43*c*, and of the lower section 52*b* of the interconnecting dowel 52 in the relative housing 53*b*, and finally the modules 2 are aligned and joined to one another in succession by means of the joint of the upper sections 42*a*, 42*b* of the interconnecting dowels 42 in the corresponding housings 43*a*, 43*b*, the joint of the upper section 52*a* of the interconnecting dowel 52 in the relative housing 53*a*, the joint of the plugs 50 in the relative housings, and the joint between the couplings 20 included on the L-shaped support 12 and the couplings 21 included on the connecting upright 11 by effect of which the L-shaped support 12 fixes to the connecting upright 11 of the underlying module, and the bolt 24 is tightened only at this point. The wardrobe 1 is completed by applying the base 6, the top 8 and the shelves 5 which engage to special supports 54, 55, 56 provided on the sides of the L-shaped support 12 and on the internal side of the lower cross-member 18 of the side panels 3.

Note that from the above description it emerges that the invention enables being able to support a shelf without having to use a dedicated support upright and optimizes the exploitability of the compartment of the wardrobe.

Obviously, changes or improvements could be made to the invention as described, dictated by incidental or special reasons, but without deviating from the scope of the invention as claimed below.

The invention claimed is:

1. An assemblable wardrobe made of a plastic material, comprising a first and at least a second module positioned one above the other, where each module comprises two side panels, a rear panel, at least a shelf and a reinforcing structure, wherein that said reinforcing structure comprises an upper cross-member and respectively a lower cross-member arranged along upper and respectively lower sides of the rear panel and a connecting upright joining said cross-members, each module further comprising an L-shaped support having a vertical wing connected along said connecting upright and a horizontal wing supporting the shelf, said L-shaped support having a clamp configured to clamp the upper cross-member to the lower cross-member of the overlying module, wherein said rear panel has side uprights and said side panels have rear uprights juxtaposed at said side uprights at the lateral sides thereof, having upper couplings and lower couplings for reciprocal connection, wherein the upper coupling of the side upright of the rear panel is formed by a tapered engaging tooth which vertically extends below a shoulder of the side upright of the rear panel, and the corresponding upper coupling of the rear upright of the side panel is formed by a cavity which vertically extends inside a shoulder of the rear upright of the side panel.

2. The assemblable wardrobe made of a plastic material, according to claim 1, wherein in that said cross-members are formed in a single piece with said rear panel.

3. The assemblable wardrobe made of a plastic material, according to claim 1, wherein in that said connecting upright is formed in a single piece with said rear panel.

4. The assemblable wardrobe made of a plastic material, according to claim 1, wherein in that said vertical wing is connected along the connecting upright by engagement of grooved couplings with corresponding grooved couplings of the connecting upright.

5. The assemblable wardrobe made of a plastic material, according to claim 1, wherein in that said clamp comprises at least a grooved coupling engaged with a corresponding grooved coupling of said lower cross-member of the overlying module.

6. The assemblable wardrobe made of a plastic material, according to claim 5, wherein that said clamp comprises at least a locking bolt of said L-shaped support locking said lower cross-member of the overlying module.

7. The assemblable wardrobe made of a plastic material, according to claim 1, further comprises interconnecting dowels at the corners between modules.

8. The assemblable wardrobe made of a plastic material, according to claim 7, wherein that said dowels have teeth inserted in snap-fitting blocking seatings of the connection.

9. The assemblable wardrobe made of a plastic material, according to claim 1, wherein that said side panel has a frame formed in single piece with said side panel and comprising said rear upright, a front upright, an upper cross-member and a lower cross-member.

10. The assemblable wardrobe made of a plastic material, according to claim 1, further comprising connecting plugs formed in a single piece with said upper cross-member of said rear panel, which connect to the lower cross-member of the rear panel of the overlying module.

11. An assemblable wardrobe made of a plastic material, comprising a first and at least a second module positioned one above the other, where each module comprises two side panels, a rear panel, at least a shelf and a reinforcing structure, wherein that said reinforcing structure comprises an upper cross-member and respectively a lower cross-member arranged along upper and respectively lower sides of the rear panel and a connecting upright joining said cross-members, each module further comprising an L-shaped support having a vertical wing connected along said connecting upright and a horizontal wing supporting the shelf, said L-shaped support having a clamp configured to clamp the upper cross-member to the lower cross-member of the overlying module, wherein that said rear panel has side uprights and said side panels have rear uprights juxtaposed at said side uprights at the lateral sides thereof, having upper couplings and lower couplings for reciprocal connection, wherein that the lower coupling of the side upright of the rear panel 4 is in the form of a groove which faces a window which, starting from the lower end of the lateral side of the side upright of the rear panel extends vertically along the lateral side of the side upright of the rear panel, and the lower coupling of the rear upright of the side panel is in the form of a vertical protrusion which extends outside the lateral side of the rear upright of the side panel, said vertical protrusion being connected only at the lower end thereof to the lateral side of the rear upright of the side panel in order to be able to slide in the groove.

12. A kit for an assemblable wardrobe made of a plastic material, comprising a first and at least a second module that are superposable, where for the construction of each module a separate and independent plurality of components is included, comprising a rear panel, two side panels couplable to the rear panel, at least a shelf, and an L-shaped support for the shelf, wherein that a reinforcing structure is integrated in said rear panel comprising an upper cross-member and respectively a lower cross-member arranged along upper and respectively lower sides of the rear panel and a connecting upright joining said cross-members, said L-shaped support having a vertical wing that is connectable along said upright and a horizontal wing having a clamp configured to clamp the upper cross-member to the lower cross-member of the overlying module, wherein said rear panel has side uprights and said side panels have rear uprights juxtaposed at said side uprights at the lateral sides thereof, having upper couplings and lower couplings for reciprocal connection, wherein the upper coupling of the side upright of the rear panel is formed by a tapered engaging tooth which vertically extends below a shoulder of the side upright of the rear panel, and the corresponding upper coupling of the rear upright of the side panel is formed by a cavity which vertically extends inside a shoulder of the rear upright of the side panel.

* * * * *